US008721011B2

(12) United States Patent
Salice

(10) Patent No.: US 8,721,011 B2
(45) Date of Patent: May 13, 2014

(54) ASSEMBLY OF AN AUTOMATIC OPENING AND CLOSING DEVICE AND A RETAINING DEVICE FOR A DISPLACEABLE PART OF AN ARTICLE OF FURNITURE

(75) Inventor: Luciano Salice, Carimate (IT)

(73) Assignee: Arturo Salice S.p.A., Novedrate (Como) (IT)

( * ) Notice: Subject to any disclaimer, the term of this patent is extended or adjusted under 35 U.S.C. 154(b) by 0 days.

(21) Appl. No.: 13/813,256

(22) PCT Filed: Mar. 19, 2012

(86) PCT No.: PCT/EP2012/054771

§ 371 (c)(1),
(2), (4) Date: Jan. 30, 2013

(87) PCT Pub. No.: WO2012/130652

PCT Pub. Date: Oct. 4, 2012

(65) Prior Publication Data

US 2013/0134852 A1 May 30, 2013

(30) Foreign Application Priority Data

Mar. 30, 2011 (IT) ..... MI2011A0517

(51) Int. Cl.
*A47B 95/00* (2006.01)

(52) U.S. Cl.
USPC ..... 312/333; 312/334.44

(58) Field of Classification Search
USPC ..... 312/319.1, 333, 334.6–334.8, 312/334.44–334.47
See application file for complete search history.

(56) References Cited

U.S. PATENT DOCUMENTS 7,210,198 B2 * 5/2007 Hoshide et al. ..... 16/96 R

FOREIGN PATENT DOCUMENTS

| | | |
|---|---|---|
| DE | 202009000038 | 6/2010 |
| DE | 202009005256 | 11/2010 |
| DE | 102009026142 | 1/2011 |

OTHER PUBLICATIONS

International Search Report and Written Opinion; International Application No. PCT/EP2012/054771; International Filing Date: Mar. 19, 2012; 11 pages.

* cited by examiner

*Primary Examiner* — Matthew Ing
(74) *Attorney, Agent, or Firm* — Blank Rome LLP

(57) ABSTRACT

The assembly of an automatic opening and closing device and a retaining device for a displaceable part of an article of furniture. The automatic opening and closing device includes a first cursor (8) mobile such as to be selectively engageable with drawing pins (39, 40, 43) operatively connected to the displaceable part of the article of furniture; a first elastic elements (9), and a second elastic element. The retaining device includes a second cursor (21), mobile along a first sliding guide (20) on a base body (19) such as to be selectively engageable with the drawing pins; a hooking element (23) connected movably to the second cursor (21) and selectively slidable along a second sliding guide (22) or along a third sliding guide (24) provided in the base body (19), and blocking elements in the base body (19), associated to the third sliding guide (24) for releasably blocking the hooking element (23).

13 Claims, 6 Drawing Sheets

ASSEMBLY OF AN AUTOMATIC OPENING AND CLOSING DEVICE AND A RETAINING DEVICE FOR A DISPLACEABLE PART OF AN ARTICLE OF FURNITURE

The present invention relates to a retaining device for an automatic opening and closing device for a displaceable part of an article of furniture, to an automatic opening and closing device for a displaceable part of an article of furniture incorporating the retaining device, and an article of furniture which incorporates the automatic opening and closing device.

In the field of articles of furniture having drawers without handles or like opening means, use is known of guide for drawers provided with suitable means conformed such as to enable opening by pushing and automatic closing of the drawers.

The guides, following a push on the closed drawer by the user, generate a displacement of the drawer in the opening direction by a first tract, which is sufficient for the user to grip the drawer such as to open it completely.

For the correct functioning of the guide, following the first initial displacement tract generated by the guide, the user must impart to the drawer at least a second displacement tract in an opening direction, necessary such as to reset the means that have generated the opening of the drawer and contemporaneously to reset the device which has the task of performing the automatic closing.

Thus, in a case in which the drawer is opened for the first tract and is then reclosed by the user before the second displacement tract in an opening direction has been completed, there is a critical operating condition in which the auto-closing device has not been activated to close and keep closed the drawer and the opening means act such as to prevent even a manual reclosing of the drawer.

The technical task of the present invention is therefore to realise a retaining device for an automatic opening and closing device for a displaceable part of an article of furniture, which obviates the technical drawback found in the prior art.

The technical task of the present invention is attained by realising an assembly of automatic opening and closing device and a retaining device for a displaceable part of an article of furniture, the automatic opening and closing device comprising:

- a first cursor mobile such as to be selectively engageable with drawing pins operatively connected to the displaceable part of the article of furniture, and
- first elastic elements, operatively connected to said first cursor, said first elastic elements soliciting the first cursor in a closing direction of the displaceable part of the article of furniture, characterised in that said retaining device comprises:

- a second cursor, mobile along a first sliding guide on a base body such as to be selectively engageable with said drawing pins,
- a hooking element connected movably to the second cursor and selectively slidable along a second sliding guide or along a third sliding guide provided in said base body, and
- blocking means in said base body, associated to said third sliding guide for releasably blocking said hooking element.

If the user correctly performs the complete opening of the drawer, the intervention of the retaining device is advantageously excluded. If the user, on the other hand, performs only a partial opening of the drawer, which does not enable resetting of the automatic closing device, the retaining device intervenes and ensures blocking the drawer when the drawer is returned into the closed position.

The invention further relates to an article of furniture which incorporates the above assembly of an automatic opening and closing device and a retaining device.

Other characteristics of the present invention are further defined in the following claims.

Further characteristics and advantages of the invention will better emerge from the description that follows of a preferred but not exclusive embodiment of the retaining device for an automatic opening and closing device for a displaceable part of an article of furniture according to the invention, illustrated by way of an indicative and non-limiting example in the accompanying drawings, in which:

FIGS. 1 and 1*a* respectively illustrate an axonometric view and a plan view of a guide incorporating the retaining device;

Figure 1:
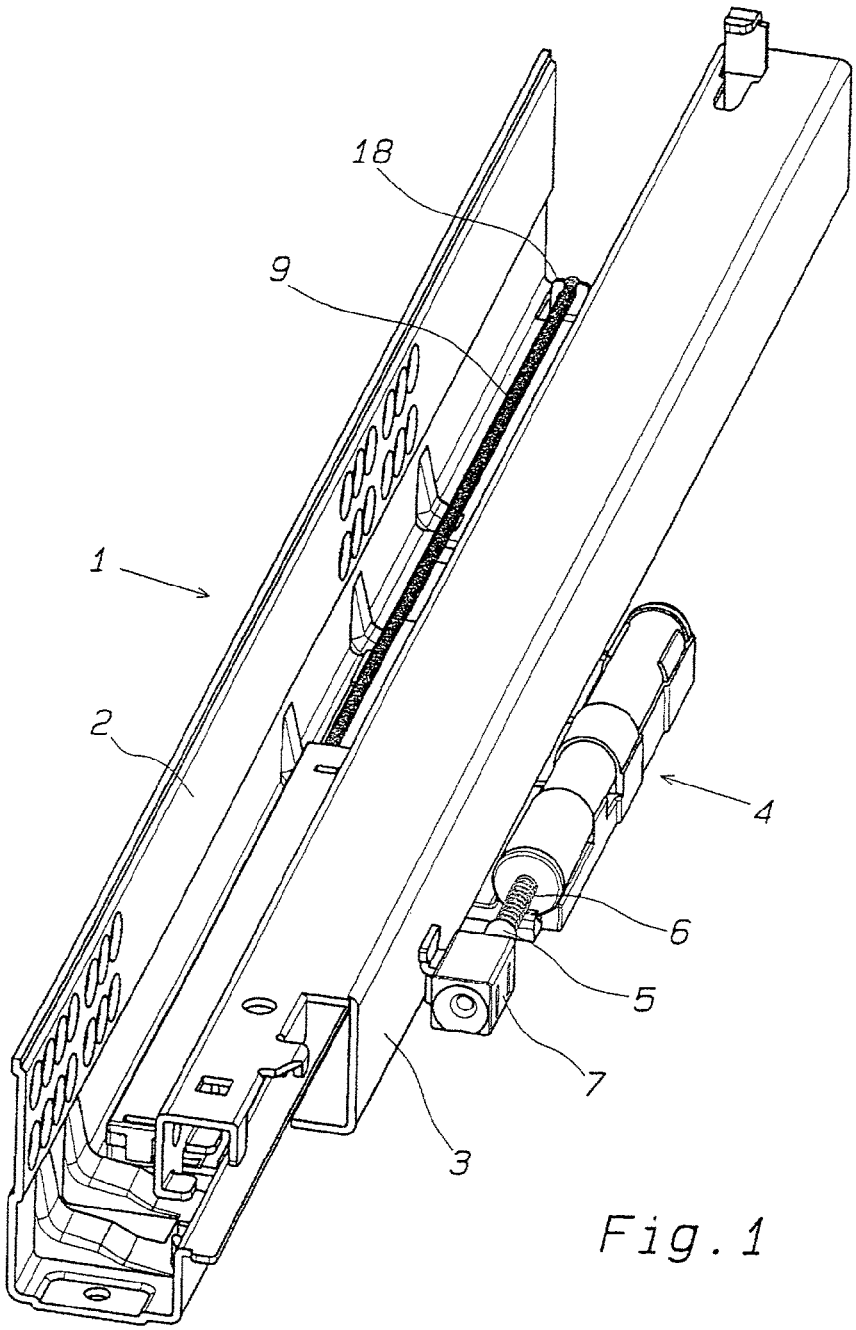
Figure 1A:
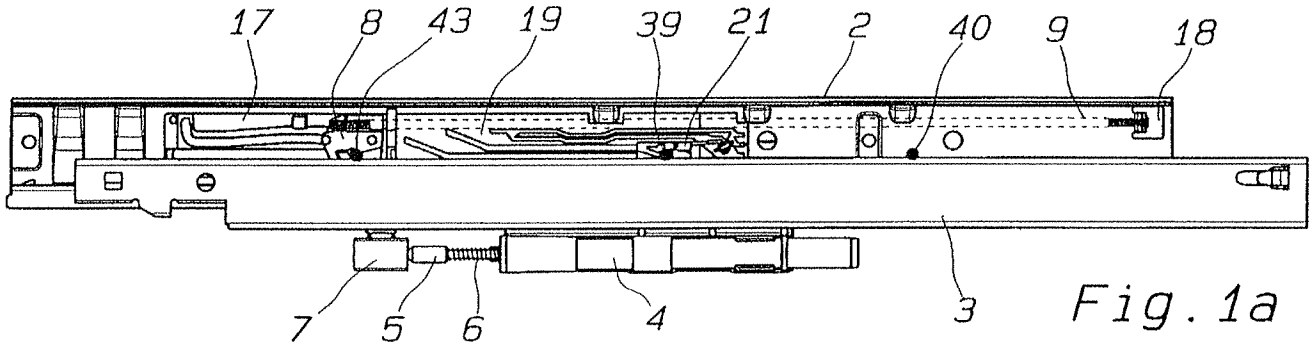

With reference to the figures, a longitudinal guide is shown for a displaceable part of an article of furniture, denoted in its entirety by reference numeral 1.

The guide 1 exhibits a fixed guide part 2, applicable to the fixed part of the article of furniture, and a displaceable guide part 3 applicable to the displaceable part of the article of furniture, such as a drawer.

The displaceable guide part 3 has a front drawing pin 43 of greater length, a rear drawing pin 40 and an intermediate drawing pin 39, both being shorter than the front drawing pin 43.

The drawing pins 39, 40 and 43 are reciprocally solidly constrained in displacement and are aligned in the displacement direction of the displaceable guide part 3.

The guide 1 is provided with a device for automatic opening and closing of the displaceable part of the article of furniture.

The device for automatic opening and closing comprises a linear decelerator 4, for example of the piston type, fixed to the fixed guide part 2.

The decelerator 4 is provided with a stem 5 that is mobile in the displacement direction of the displaceable guide part 3 by action of and in contrast to an elastic element 6 constituted for example by a helix spring.

The displaceable guide part 3 exhibits a stop 7 interceptable by the head of the stem 5.

The device for automatic opening and closing further comprises a first cursor 8 that is slidable in contrast to and by action of first elastic elements 9 along a guide 10 formed on a flat wall 17 of the base body of the opening and closing device.

The first elastic elements 9 are more rigid than the elastic element 6 and comprise in particular a helix spring anchored at one end to the first cursor 8 and at the other end to an anchoring element 18 located in a rear position on the fixed guide part 2.

The guide 10 comprises a longitudinal guide tract 11 which extends substantially in the displacement direction of the displaceable guide part 3 and from which a first tract of transversal guide 12 frontally extends, a second tract of transversal guide 13 posteriorly extends, and a third tract of transversal guide 14 intermediately extends.

The first cursor 8 is fitted with a front guide pin 15 and a rear guide pin 16 that are slidable along the guide 10.

The automatic opening and closing device advantageously exhibits a retaining device comprising a flat base body 19 having a first sliding guide 20 for a second cursor 21, a second sliding guide 22 for a hooking element 23 movably connected to the second cursor 21 and selectively slidable along the second sliding guide 22 or along a third sliding guide 24 present in the base body 19 and cooperating with blocking means 25 in the base body 19 associated to the third sliding guide 24, for releasably blocking the hooking element 23.

The base body 19 is advantageously adjacent to the flat wall 17 of the base body of the opening and closing device and can be made in a single piece therewith or be constituted by a separate element.

The third sliding guide 24 is positioned parallel to the second guide 22.

The blocking means 25 are arranged in a zone adjacent to the rear end of the third guide 24 and comprise a tooth 26 which is elastically yielding and to which the hooking element 23 can be engaged.

The base body 19 has a recess 27 which extends perimetrally to the tooth 26 such as to give the desired elastic yielding property thereto.

The recess 27 extends through the entire thickness of the base body 19.

The recess 27 further separates the tooth 26 from a fixed additional tooth 28 also present on the base body 19 for stopping the hooking element 23.

The hooking element 23 comprises a shaped pin pivoted to the second cursor 21 and exhibiting an oscillation axis perpendicular to the base body 19.

The second sliding guide 22 and the third sliding guide 24 have longitudinal tracts parallel to one another, reciprocally connected by a frontal connecting tract 31 and a rear connecting tract 32. The longitudinal tracts extend substantially in the displacement direction of the displaceable guide part 3.

The first sliding guide 20 comprises a first longitudinal tract 33 and a second longitudinal tract 34 parallel to one another, a first transversal tract 35 projecting frontally of the first longitudinal tract 33 and a second transversal tract 36 projecting frontally of the second longitudinal tract 34 and parallel to the first transversal tract 35. The longitudinal tracts 33 and 34 extend substantially in the displacement direction of the displaceable guide part 3.

The longitudinal tracts 33 and 34 of the first guide 20 mainly develop laterally of the longitudinal tracts of the second guide 22 and the third guide 24, while the transversal tracts 35 and 36 of the first guide 20 terminate frontally of the second guide 22.

The first transversal tract 35 and the second transversal tract 36 of the first guide 20 are destined to cause a lateral displacement of the second cursor 21 with respect to the displacement direction of the displaceable guide part 3.

The second cursor 21 has a front intercepting wall 37, an intermediate intercepting wall 38, a rear intercepting wall 46, and an abutment 47 positioned posteriorly of the rear intercepting wall 46 and laterally offset from the walls 37, 38 and 46.

The walls 37, 38, and 46 of the second cursor 21 are suitable for interacting with the drawing pins 39 and 40, while the abutment 47 is destined to interact with only the rear drawing pin 40 for the second cursor 21.

The second cursor 21 further exhibits a front guide pin 41 that is slidable along the first longitudinal tract 33 and the first transversal tract 35 of the first guide 20, and a rear guide pin 42 slidable along the second longitudinal tract 34 and the second transversal tract 36 of the first guide 20.

The operation of the retaining device according to the invention is apparent from what is described and illustrated.

In figures from 2 to 12, the displaceable guide 3 has been schematically illustrated with a bold line only in the part that bears the drawing pins 39, 40 and 43.

The drawer is initially in the closed position.

Figure 2:
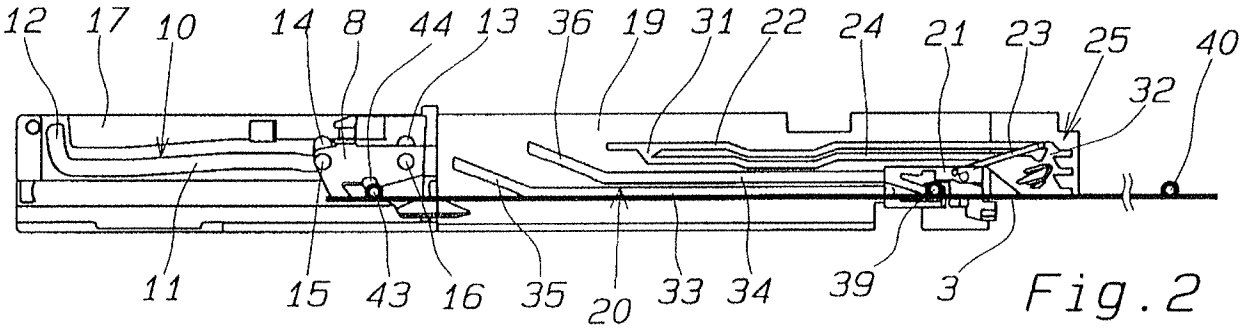
FIG. 2 is a schematic view of the automatic opening and closing device in the closed position of the drawer in which the retaining device cannot intervene.

The guide 1 assumes the position illustrated in FIGS. 1 and 2.

The stop 7 is positioned against the head of the stem 5 of the decelerator 4.

The front drawing pin 43 of the displaceable guide part 3 engages a recess 44 of the first cursor 8 which is retained at the rear end of the longitudinal tract 11 of the guide 10 by the first elastic elements 9.

The second cursor 21 is positioned at the rear end of the longitudinal tracts 33 and 34 of the first guide 20 and the intermediate drawing pin 39 of the displaceable guide part 3 is retained between the front wall 37 and the intermediate wall 38 of the second cursor 21.

The hooking element 23 is at the rear end of the second guide 22.

Figure 3:
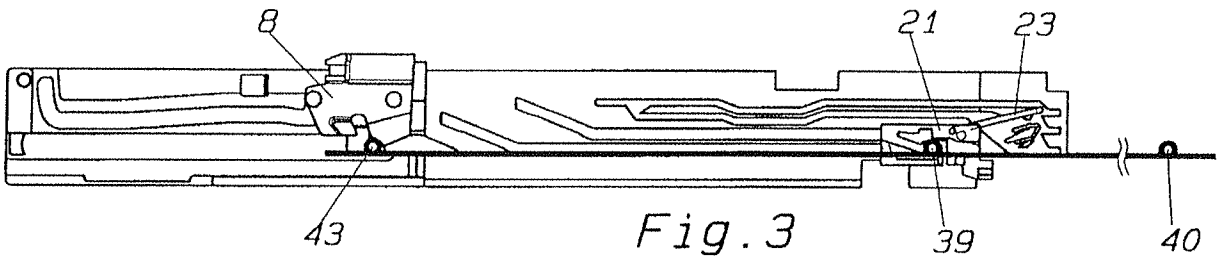
FIG. 3 is a schematic view of the automatic opening and closing device in the subsequent configuration to the configuration of FIG. 2, attained when the user presses on the closed drawer in order to re-open it.
Figure 4:
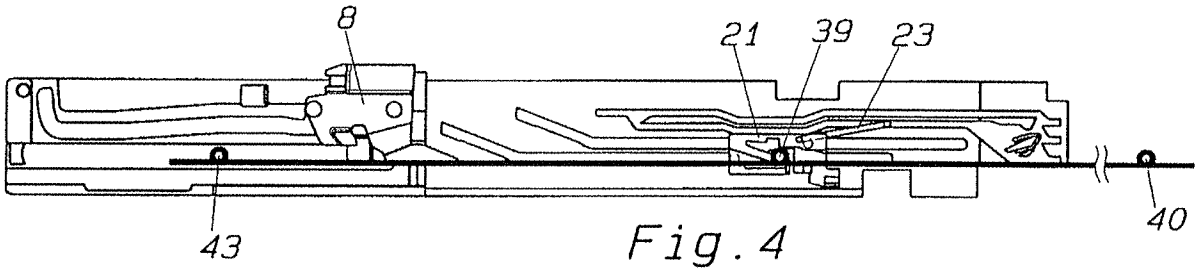
FIG. 4 is a schematic view of the automatic opening and closing device in the subsequent configuration to the configuration of FIG. 3, attained during the opening of the drawer.
Figure 5:
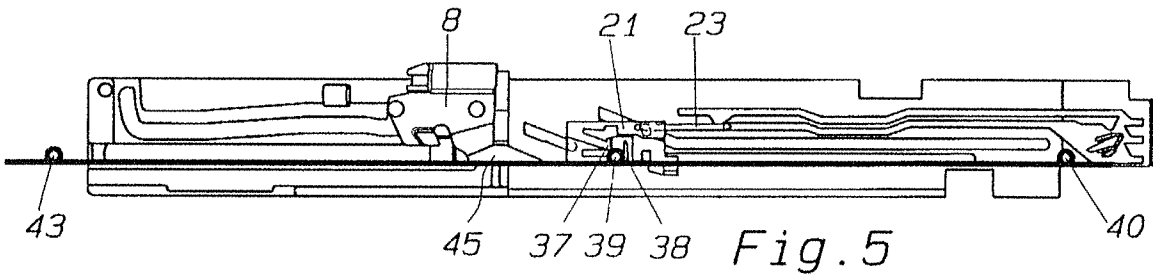
FIG. 5 is a schematic view of the automatic opening and closing device in the subsequent configuration to the configuration of FIG. 4, attained during the opening of the drawer after the first lateral displacement of the cursor of the retaining device.

When the user exerts a gentle push on the closed drawer (FIG. 3) the displaceable guide part 3 slightly retracts and the front drawing pin 43 displaces the first cursor 8 laterally, which first cursor 8 engages with the guide pins 15 and 16 of the transversal guide tracts 13 and 14.

By effect of the lateral displacement the first cursor 8 thus frees the front drawing pin 43 from the recess 44 and allows the initial displacement in the opening direction of the drawer, by effect of the expansion of the elastic element 6.

During this step, the second cursor 21 is pushed slightly retractingly by the action of the drawing pin 39 against the wall 38 and the hooking element 23 thus passes from the rear end of the longitudinal tract of the guide 22 to the rear end of the longitudinal tract of the guide 24, transiting along the connecting guide tract 32.

At this point there may be different operating conditions depending on whether the user decides to close the drawer before or after the complete opening of the same.

In the case of a complete opening before the closing of the drawer, the sequence is the one shown in FIGS. 2 to 8.

During completion of the opening of the drawer, done manually by the user, a special tab 45 of the first cursor 8 is engaged by the intermediate intercepting pin 39 which frees the guide pins 15 and 16 of the first cursor 8 from the transversal guide tracts 13 and 14, hooks a tooth located frontally of the recess 44 and draws the first cursor 8 along the longitudinal guide 11 up to causing it to oscillate by effect of the engagement of the front guide pin 15 in the front transversal guide tract 12.

The first elastic elements 9 retain the first cursor 8 set in this rotated position at front end stop of the guide 10, in which once more the tooth located in front of the recess 44 has been displaced laterally. In this position also the drawing pins 39 and 40 pass beyond the first cursor 8 as they exhibit an insufficient length to engage in the recess 44.

During the tract of completion of the drawer opening, when it engages the tracts of transversal guide 35 and 36 with the guide pins 41 and 42, the first cursor 21 undergoes a first lateral displacement by effect of the engagement of the inter mediate intercepting pin 39 with the front wall 37, at the end of which it is passed over by the intermediate intercepting pin 39, and a second lateral displacement by effect of the engagement of the rear intercepting pin 40 with the rear wall 46 which has become aligned with the trajectory of the rear intercepting pin 40 by effect of the first lateral displacement.

As a result of the second lateral displacement of the second cursor 21, which occurs only after the intermediate intercepting pin 39 has drawn the first cursor 8 along the longitudinal guide tract 11 and it has caused it to oscillate by engaging with the front guide pin 15 in the front transversal guide tract 12, the rear wall 46 is passed over by the rear intercepting pin 40, the hooking element 23 passes along the front connecting guide tract 31 suitably shaped for passage from the longitudinal tract of the third guide 24 to the longitudinal tract of the second guide 22, and the abutment 47 aligns with the trajectory of the rear intercepting pin 40.

During closing of the drawer (FIG. 7) the drawing pins 39 and 40 again pass beyond the recess 44, while the longer front drawing pin 43 engages the recess 44 and determines the release of the first cursor 8 from its position.

By the action of the first elastic elements 9, the first cursor 8 draws the displaceable guide part 3 in retraction up to causing the stop 7 to impact against the head of the stem of the piston decelerator 4, which opposes the action of the first elastic elements 9 to ensure a gentle and gradual closing of the drawer.

Further, during closing of the drawer the rear drawing pin 40 intercepts the abutment 47 of the second cursor 21 such as to return the second cursor 21 into the former position thereof before the second lateral displacement thereof, and subsequently intermediate drawing pin 39 engages the wall 39 of the second cursor 21, returning it to the initial position thereof.

Figure 6:
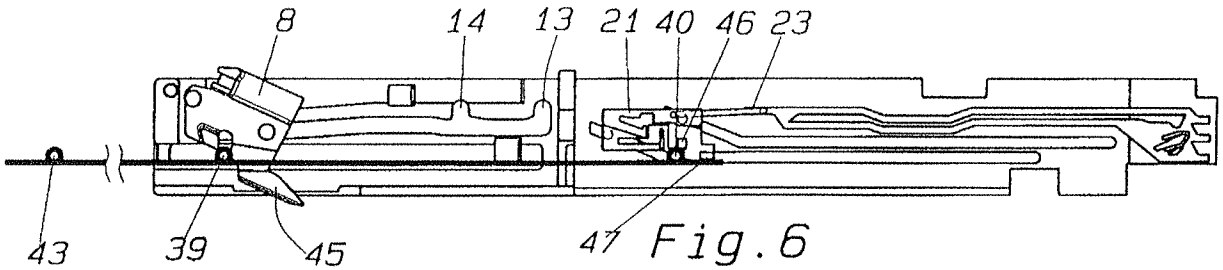
FIG. 6 is a schematic view of the automatic opening and closing device in the subsequent configuration to the configuration of FIG. 5, attained during the opening of the drawer after the second lateral displacement of the cursor of the retaining device.
Figure 7:
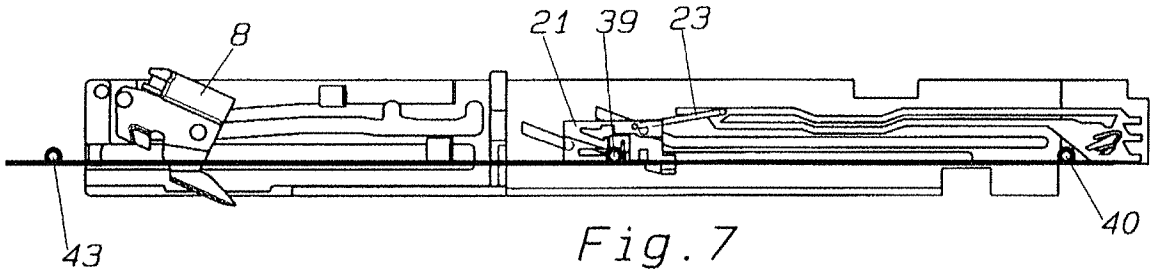
FIG. 7 is a schematic view of the automatic opening and closing device in the subsequent configuration to the configuration of FIG. 6, attained during the closing of the drawer after the cursor of the retaining device has performed, in reverse order, the second lateral displacement.
Figure 8:
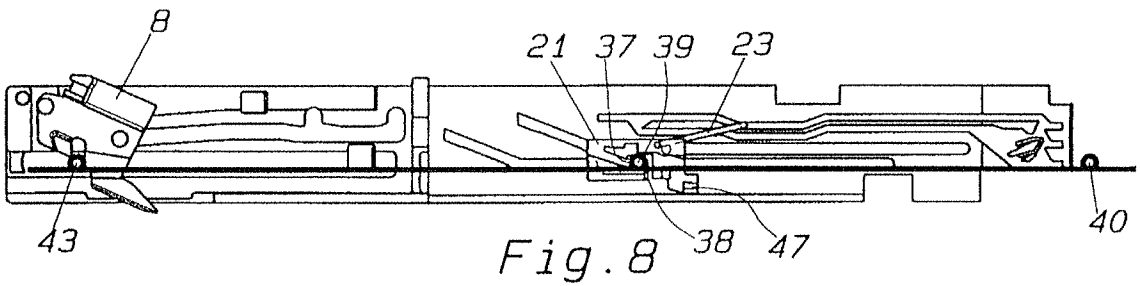
FIG. 8 is a schematic view of the automatic opening and closing device in the subsequent configuration to the configuration of FIG. 7, attained during the closing of the drawer after the cursor of the retaining device has performed, in reverse order, the first lateral displacement.

A different scenario occurs when performing a partial opening, in which the drawer is extracted for a distance that is not sufficient to load the cursor 8 up to the position illustrated in FIGS. 6, 7, 8 and to move the second cursor 21 sufficiently for the hooking element 23 to pass from the longitudinal tract of the guide 24 to the longitudinal tract of the guide 22.

Figure 9:
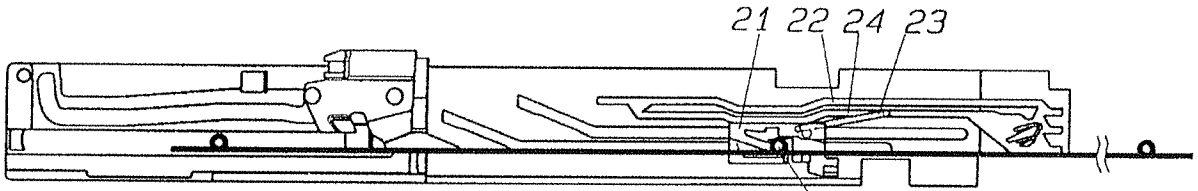
FIG. 9 is a schematic view of the automatic opening and closing device in a partially-open position of the drawer, from which the drawer can be closed and blocked in the closed position by intervention of the retaining device.
Figure 10:
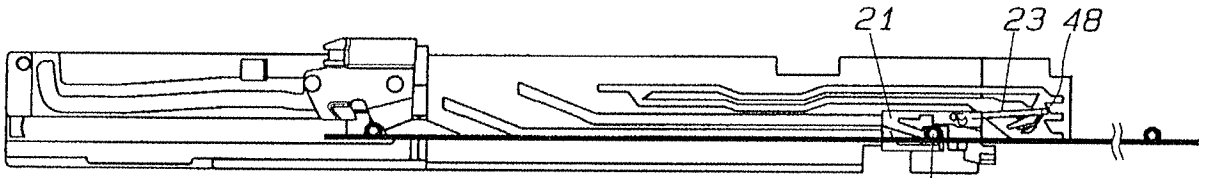
FIG. 10 is a schematic view of the automatic opening and closing device in a subsequent configuration to the configuration of FIG. 9, attained during closing of the drawer, in which the hooking element engages the third guide.
Figure 11:
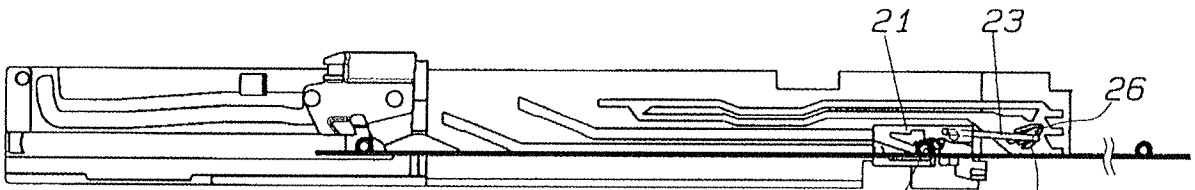
FIG. 11 is a schematic view of the automatic opening and closing device in a configuration subsequent to the configuration of FIG. 10, in which the retaining device retains the drawer in a closed position.
Figure 12:
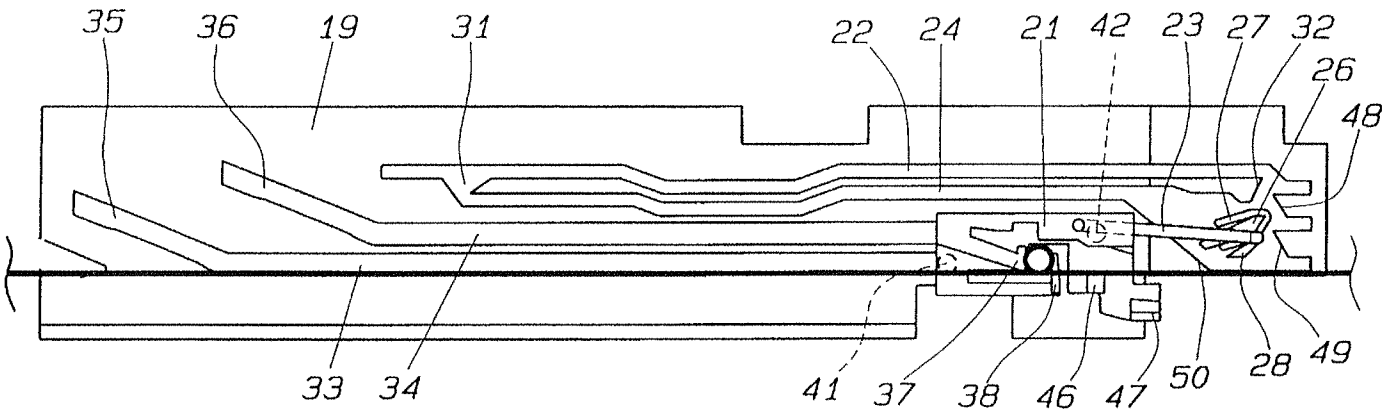
FIG. 12 is an enlarged view of the retaining device in the position of FIG. 11.
Figure 13:
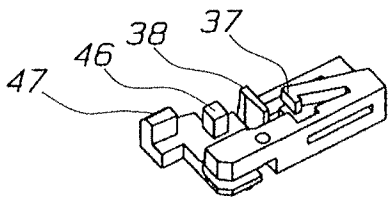
FIG. 13 is an axonometric view of the cursor of the retaining device.
Figure 14:
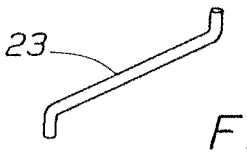
FIG. 14 is an axonometric view of the hooking element.

In this case the sequence of configurations of the guide 1 during the closing of the drawer is as illustrated in FIGS. 9, 10 and 11.

When the drawer begins to close, the second cursor 21 is still positioned along the longitudinal guide tracts 33 and 34 and the hooking element 23 is positioned along the longitudinal tract of the guide 24.

The intermediate drawing pin 39 is retained between the front intercepting wall 37 and the intermediate intercepting wall 38 of the second cursor 21.

As the hooking element 23 runs backwards, i.e. from the front end to the rear end, the longitudinal tract of the guide 24 is guided towards an inclined surface 48 of the blocking means 25 which brings it to engage between the stop element 26 and the fixed element 28.

The hooking element 23, thus hooked to the stop element 26, blocks the drawer in the closed position.

As a result of a subsequent push on the closed drawer, to re-open it, at this point the hooking element 23 is guided towards a second inclined surface 49 and subsequently towards a third inclined surface 50 which return it to the longitudinal tract of the guide 24.

If at this point the user completes the opening, the first-described operating condition is newly achieved, whereas if not the just-described condition remains.

In a case where, in the second hypothetical scenario, the user acts wrongly and tries to open the closed drawer not with a push, but with an initial traction force, the hooking element 23 jointed between the elastic stop element 26 and the fixed element 28 flexes the elastic stop element 26 and, being freed from the joint, it returns on the longitudinal tract of the guide 24.

The retaining device for the automatic opening and closing device for the displaceable part of an article of furniture as conceived herein is susceptible to numerous modifications and variants, all falling within the inventive concept; moreover, all details can be replaced by technically-equivalent elements.

In practice the materials used, as well as the dimensions, may be any according to requirements and the state of the art.

The invention claimed is:

1. An assembly of an automatic opening and closing device and a retaining device for a displaceable part of an article of furniture, the automatic opening and closing device comprising:

a first cursor, mobile such as to be selectively engageable with drawing pins in an opening position or a closing position of the displaceable part of the article of furniture, where the drawing pins are operatively connected to the displaceable part of the article of furniture, a first elastic element, operatively connected to said first cursor, said first elastic elements soliciting the first cursor in a closing direction of the displaceable part of the article of furniture, and, a second elastic element, acting in an opening direction of the displaceable part of the article of furniture, and the retaining device comprising:

a second cursor mobile along a first sliding guide on a base body such as to be selectively engageable with said drawing pins;

a hooking element connected movably to the second cursor and selectively slidable along a second sliding guide or along a third sliding guide provided in said base body; and blocking members in said base body, associated to said third sliding guide, the blocking members releasably blocking said hooking element.

2. The assembly of an automatic opening and closing device and a retaining device for a displaceable part of an article of furniture of claim 1, wherein said first, said second and said third sliding guide, and said blocking member, are present in a flat wall of said base body.

3. The assembly of an automatic opening and closing device and a retaining device for a displaceable part of an article of furniture of claim 2, wherein said hooking element includes a profiled pin pivoted to said second cursor and exhibiting an oscillating axis that is perpendicular to said flat wall of said base body.

4. The assembly of an automatic opening and closing device and a retaining device for a displaceable part of an article of furniture of claim 1, wherein said second sliding guide and said third sliding guide exhibit longitudinal tracts which are parallel to one another, connected to one another by a front connecting tract and by a rear connecting tract.

5. The assembly of an automatic opening and closing device and a retaining device for a displaceable part of an article of furniture of claim 1, wherein said blocking member is positioned in a zone that is adjacent to a rear end of said third sliding guide.

6. The assembly of an automatic opening and closing device and a retaining device for a displaceable part of an article of furniture of claim 1, wherein said first sliding guide includes a first and a second parallel longitudinal tract, a first transversal tract extending frontally from said first parallel longitudinal tract, and a second transversal tract extending frontally from said second parallel longitudinal tract, said first and said second transversal tracts being destined to cause a first and a second lateral displacement of the second cursor with respect to a displacement direction of a displaceable guide part by effect of respective drawing pins.

7. The assembly of an automatic opening and closing device and a retaining device for a displaceable part of an article of furniture of claim 6, wherein said second cursor exhibits a front guide pin, slidable along said first longitudinal tract and said first transversal tract of said first sliding guide and a rear guide pin slidable along said second longitudinal tract and said second transversal tract of said first sliding guide.

8. The assembly of an automatic opening and closing device and a retaining device for a displaceable part of an article of furniture of claim 6, wherein a front connecting tract is conformed such as to cause a displacement of said hooking element from a longitudinal tract of said third sliding guide to a longitudinal tract of said second sliding guide when said second cursor performs a second lateral displacement.

9. The assembly of an automatic opening and closing device and a retaining device for a displaceable part of an article of furniture according of claim 1, wherein said second cursor exhibits intercepting walls suitable for interacting with appropriate drawing pins, and an abutment laterally offset from said intercepting walls and destined to interact with one of said drawing pins.

10. The assembly of an automatic opening and closing device and a retaining device for a displaceable part of an article of furniture of claim 1, wherein said blocking member includes an elastically yieldable tooth against which said hooking element is engageable.

11. The assembly of an automatic opening and closing device and a retaining device for a displaceable part of an article of furniture of claim 10, wherein said base body includes a recess which develops perimetrally of said tooth in order to give the tooth the desired elastic yieldability.

12. The assembly of an automatic opening and closing device and a retaining device for a displaceable part of an article of furniture of claim 1, wherein said base body exhibits, frontally of said first, second and third sliding guides, a guide of the first cursor, said further guide being present in a flat wall of an element that is separated from said base body.

13. An article of furniture, comprising the assembly of an automatic opening and closing device and a retaining device according to claim 1.

* * * * *